US011276514B2

(12) United States Patent
Pusthay et al.

(10) Patent No.: US 11,276,514 B2
(45) Date of Patent: Mar. 15, 2022

(54) INSULATOR SYSTEMS WITH CORONA SUPPRESSION

(71) Applicant: TE Connectivity Corporation, Berwyn, PA (US)

(72) Inventors: Kiran Pusthay, Cary, NC (US); Senthil A. Kumar, Morrisville, NC (US)

(73) Assignee: TE CONNECTIVITY SERVICES GMBH, Schaffhausen (DE)

( * ) Notice: Subject to any disclaimer, the term of this patent is extended or adjusted under 35 U.S.C. 154(b) by 189 days.

(21) Appl. No.: 16/574,188

(22) Filed: Sep. 18, 2019

(65) Prior Publication Data

US 2021/0082602 A1 Mar. 18, 2021

(51) Int. Cl.
*H01B 17/42* (2006.01)
*H01B 17/38* (2006.01)
*H01B 17/66* (2006.01)

(52) U.S. Cl.
CPC ..... *H01B 17/42* (2013.01); *H01B 17/38* (2013.01); *H01B 17/66* (2013.01)

(58) Field of Classification Search
CPC ..... H01B 17/42; H01B 17/38; H01B 17/66
See application file for complete search history.

(56) References Cited

U.S. PATENT DOCUMENTS 2,415,649 A 2/1947 Matthysse
2,616,646 A 11/1952 Matthysse
3,165,577 A * 1/1965 Meier ..... H01B 17/525 174/141 R
3,692,927 A * 9/1972 Ellaschuk ..... H02G 7/00 174/139
4,039,744 A 8/1977 Seaquist
4,121,046 A * 10/1978 Fujita ..... H01B 17/42 174/140 CR
4,215,237 A 7/1980 Burtnett
4,255,615 A 3/1981 Huang et al.
4,281,213 A 7/1981 Sciscione
6,455,782 B1 9/2002 Lin et al.
6,984,790 B1 * 1/2006 Bernstorf ..... H01B 17/44 174/140 CR
10,256,615 B2 4/2019 Murugiah
2012/0186853 A1 * 7/2012 Rose ..... H01B 17/10 174/139
2017/0110865 A1 4/2017 Murugiah
2019/0103205 A1 * 4/2019 Kolehmainen ..... H01B 17/44

* cited by examiner

*Primary Examiner* — Timothy J Thompson
*Assistant Examiner* — Rhadames Alonzo Miller

(57) ABSTRACT

An insulator system includes an insulator assembly including: a first insulator; a second insulator; a first end fitting at a first end portion of the first insulator; a second end fitting at a second end portion of the first insulator; a third end fitting at a first end portion of the second insulator and operatively coupled to the second end fitting; a fourth end fitting at a second end portion of the second insulator; a first cement layer between the first insulator and the first end fitting; a second cement layer between the first insulator and the second end fitting; a third cement layer between the second insulator and the third end fitting; and a fourth cement layer between the second insulator and the fourth end fitting. An electrically insulating layer is on the first cement layer and extends between the first insulator and the first end fitting.

18 Claims, 13 Drawing Sheets

INSULATOR SYSTEMS WITH CORONA SUPPRESSION

BACKGROUND

Corona discharge is a leakage of electric current into the air adjacent high voltage conductors. It is sometimes visible as a dim blue glow in the air next to sharp points on high voltage equipment. The high electric field ionizes the air, making it conductive, and allowing current to leak from the conductor into the air in the form of ions. In electric power transmission lines and equipment, corona results in an economically significant waste of power and may deteriorate the hardware from where it originates in addition to interference to communication.

A corona ring is a toroid of conductive material, usually metal, which is attached to a terminal or other hardware piece for high voltage equipment. The role of the corona ring is to distribute the electric field gradient and lower its maximum values below the corona threshold, either preventing corona discharge entirely or transferring its destructive effects from the valuable hardware to the expendable ring. Corona rings are used on high or very high voltage power transmission insulators and switchgear.

The corona ring is electrically connected to the high voltage conductor, encircling the points where corona would form. Since the ring is at the same potential as the conductor, the presence of the ring may significantly reduce the potential gradient at the surface of the conductor, e.g., below the disruptive potential gradient, so corona does not form on, e.g., points of hardware.

SUMMARY

Some embodiments of the present invention are directed to a high voltage insulator system. The system includes an insulator assembly including: a first elongated insulator including first and second opposite end portions; a second elongated insulator comprising first and second opposite end portions; a first end fitting at the first end portion of the first insulator, the first end fitting configured to be electrically connected with a high voltage conductor; a second end fitting at the second end portion of the first insulator; a third end fitting at the first end portion of the second insulator, wherein the second end fitting and the third end fitting are operatively coupled to one another such that the first insulator and the second insulator are operatively coupled to one another with a common longitudinal axis; a fourth end fitting at the second end portion of the second insulator, the fourth end fitting configured to be coupled to a mounting structure; a first cement layer between the first insulator and an inner surface of the first end fitting; a second cement layer between the first insulator and an inner surface of the second end fitting; a third cement layer between the second insulator and an inner surface of the third end fitting; and a fourth cement layer between the second insulator and an inner surface of the fourth end fitting. An annular electrically insulating layer is on the first cement layer and extends between the first insulator and an outer annular edge of the first end fitting.

In some embodiments, the electrically insulating layer directly contacts each of the first insulator, the first cement layer, and the first end fitting.

In some embodiments, the electrically insulating layer extends continuously from an outer surface of the first insulator to the outer annular edge of the first end fitting and along an outer surface of the first end fitting. The electrically insulating layer may directly contact each of the first insulator, the first cement layer, and the outer surface of the first end fitting.

In some embodiments, the electrically insulating layer comprises room temperature vulcanizing silicone.

In some embodiments: the first end fitting is adhered to the first insulator by the first cement layer; the second end fitting is adhered to the first insulator by the second cement layer; the third end fitting is adhered to the second insulator by the third cement layer; and/or the fourth end fitting is adhered to the second insulator by the fourth cement layer.

In some embodiments, the electrically insulating layer is a first electrically insulating layer and the system further includes a second annular electrically insulating annular layer on the fourth cement layer and extending between the second insulator and an outer annular edge of the fourth end fitting. The second electrically insulating layer may directly contact each of the second insulator, the fourth cement layer, and the fourth end fitting. The second electrically insulating layer may extend continuously from an outer surface of the second insulator to the outer annular edge of the fourth end fitting and along an outer surface of the fourth end fitting. The second electrically insulating layer may directly contact each of the second insulator, the fourth cement layer, and the outer surface of the fourth end fitting.

In some embodiments, the system includes: a third annular electrically insulating layer on the second cement layer and extending between the first insulator and an outer annular edge of the second end fitting; and/or a fourth annular electrically insulating layer on the third cement layer and extending between the second insulator and an outer annular edge of the third end fitting. In some embodiments: third electrically insulating layer directly contacts each of the first insulator, the second cement layer, and the second end fitting; and/or the fourth electrically insulating layer directly contacts each of the second insulator, the third cement layer, and the third end fitting. In some embodiments: the third electrically insulating layer extends continuously from an outer surface of the first insulator to the outer annular edge of the second end fitting and along an outer surface of the second end fitting; and/or the fourth electrically insulating layer extends continuously from an outer surface of the second insulator to the outer annular edge of the third end fitting and along an outer surface of the third end fitting. In some embodiments: third electrically insulating layer directly contacts each of the first insulator, the second cement layer, and the outer surface of the second end fitting; and/or the fourth electrically insulating layer directly contacts each of the second insulator, the third cement layer, and the outer surface of the third end fitting.

Some other embodiments of the present invention are directed to a method for forming a corona suppression system on an insulator system. The method includes providing an insulating assembly including: an end fitting defining a cavity; an elongated insulator including first and second opposite end portions with the first end portion received in the cavity; and a cement layer in the cavity between an outer surface of the insulator and an inner surface of the end fitting. The method includes: fitting a mold having a bottom wall and sidewall extending upwardly from the bottom wall on the insulator with the bottom wall engaging the outer surface of the insulator and being spaced apart from the end fitting; and receiving an electrically insulating material in the mold between the sidewall and the outer surface of the insulator to form an electrically insulating layer on the cement layer that extends between the insulator and the end fitting.

In some embodiments, the electrically insulating material comprises room temperature vulcanizing silicone. The method may include, after receiving the electrically insulating material in the mold, allowing the electrically insulating material to cure to form the electrically insulating layer.

Some other embodiments of the present invention are directed to an insulator system. The system includes an insulator assembly and an annular electrically insulating layer. The insulator assembly includes: an elongated insulator including first and second opposite end portions; a first end fitting at the first end portion of the first insulator, the first end fitting configured to be electrically connected with a high voltage conductor; a second end fitting at the second end portion of the first insulator, the second end fitting connected to a mounting structure; a first cement layer between the first insulator and an inner surface of the first end fitting; and a second cement layer between the first insulator and an inner surface of the second end fitting. The annular electrically insulating layer is on the first cement layer and extends between the first insulator and an outer annular edge of the first end fitting.

In some embodiments, the second end fitting is directly connected to the mounting structure.

In some embodiments, the insulator is a first insulator. The insulator assembly may further include: a second elongated insulator comprising first and second opposite end portions; a third elongated insulator comprising first and second opposite end portions; a third end fitting at the first end portion of the second insulator, wherein the second end fitting and the third end fitting are coupled to one another such that the first insulator and the second insulator are coupled to one another with a common longitudinal axis; a fourth end fitting at the second end portion of the second insulator; a fifth end fitting at the first end portion of the third insulator, wherein the fourth end fitting and the fifth end fitting are coupled to one another such that the second insulator and the third insulator are coupled to one another with the common longitudinal axis; and a sixth end fitting at the second end portion of the third insulator. The sixth end fitting may be directly connected to the mounting structure.

In some embodiments, the system includes the high voltage conductor.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
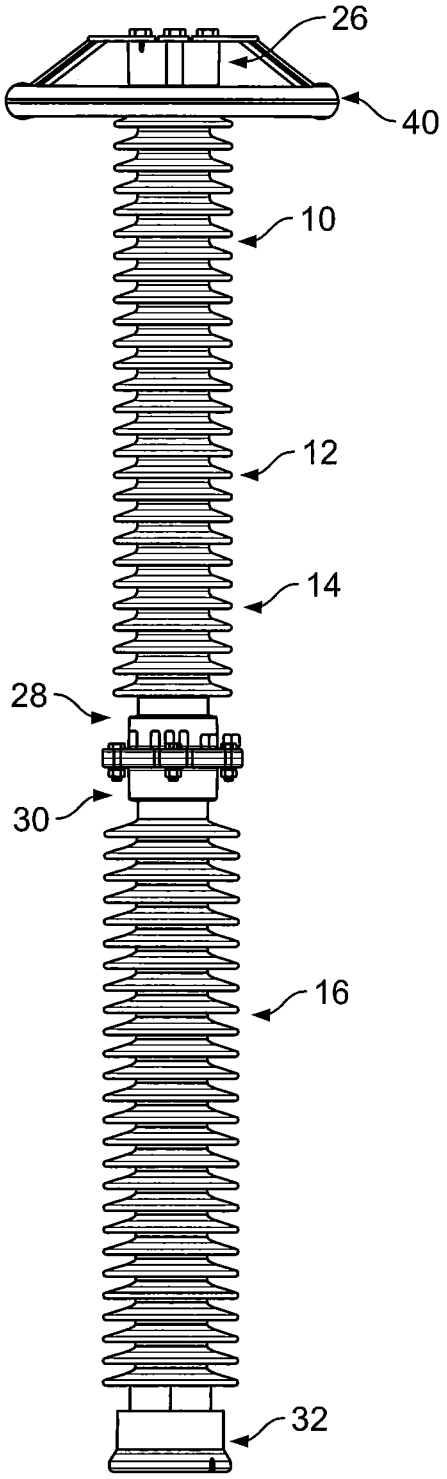
FIG. 1 (Prior Art)
FIG. 1 is a side view of a prior art insulator system employing a corona ring.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a side view of a known insulator system 10. The system 10 includes an insulator assembly 12 including a first insulator 14 and a second insulator 16. The first insulator 12 includes first and second end fittings 26, 28 and the second insulator 16 includes first and second end fittings 30, 32. The first and second insulators 14, 16 are coupled to one another using the second end fitting 28 of the first insulator 14 and the first end fitting 30 of the second insulator 16. The first end fitting 26 of the first insulator 14 is configured to be electrically connected with a high voltage conductor. The second end fitting 32 of the second insulator 16 is configured to be mounted to a mounting surface such as a line post.

A corona ring 40 is connected to the first end fitting 26 of the first insulator 14. As described above, the corona ring 40 may be positioned and sized to reduce corona discharge.

Figure 2:
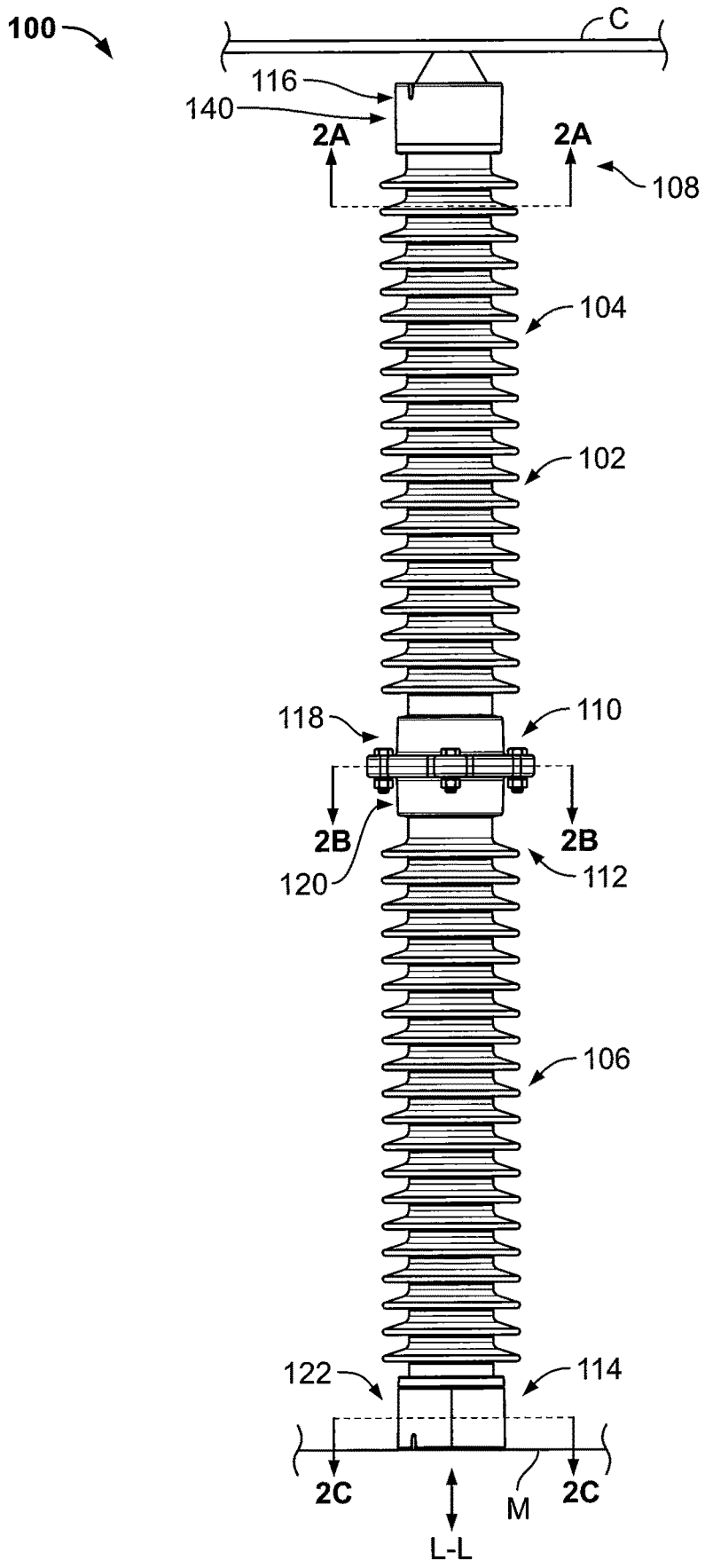
FIG. 2 is a side view of an insulator system according to some embodiments of the present invention.

Embodiments of the present invention effectively replace the corona ring with a corona suppression system. Referring to FIG. 2, an insulator system 100 includes an insulator assembly 102 including first and second insulators or insulator housings 104, 106. The first insulator 104 includes first and second opposite end portions 108, 110. A first end fitting 116 is at the first end portion 108 and a second end fitting 118 is at the second end portion 110.

Figure 2A:
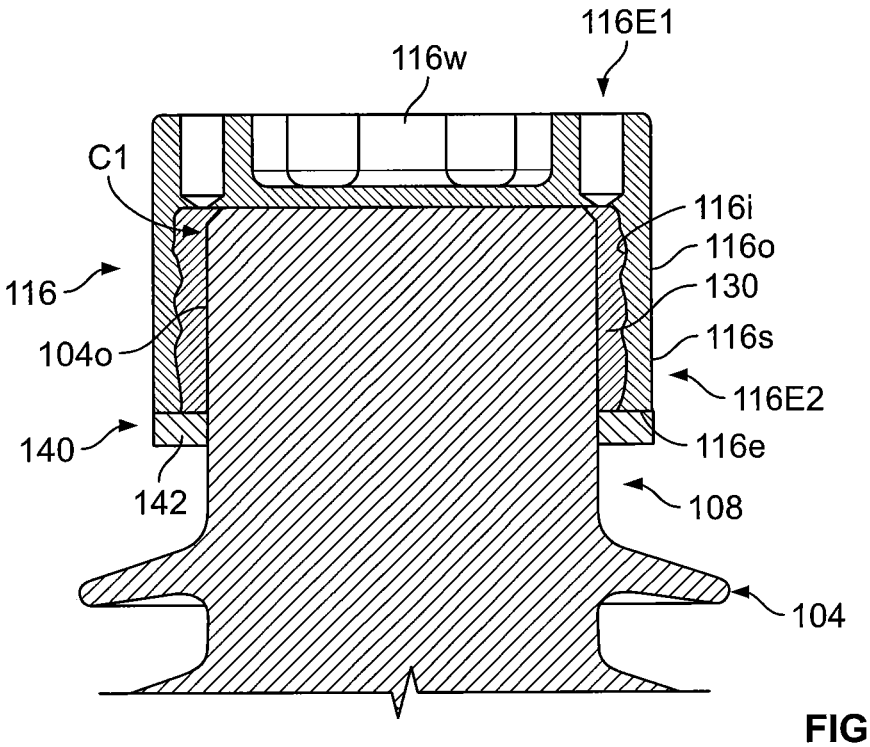
FIG. 2A is a fragmentary sectional view of the insulator system of FIG. 2 taken along line 2A-2A.

Referring to FIG. 2A, the first end fitting 116 has first and second opposite ends 116E1, 116E2. An end wall 116*w* is at the first end 116E1. A sidewall 116*s* extends between the first end 116E1 and the second end 116E2. The sidewall 116*s* terminates at the second end 116E2 and defines an annular edge 116*e*. The end wall 116*w* and the sidewall 116*s* define a cavity C1 in which the first end portion 108 of the first insulator 104 is received.

Figure 2B:
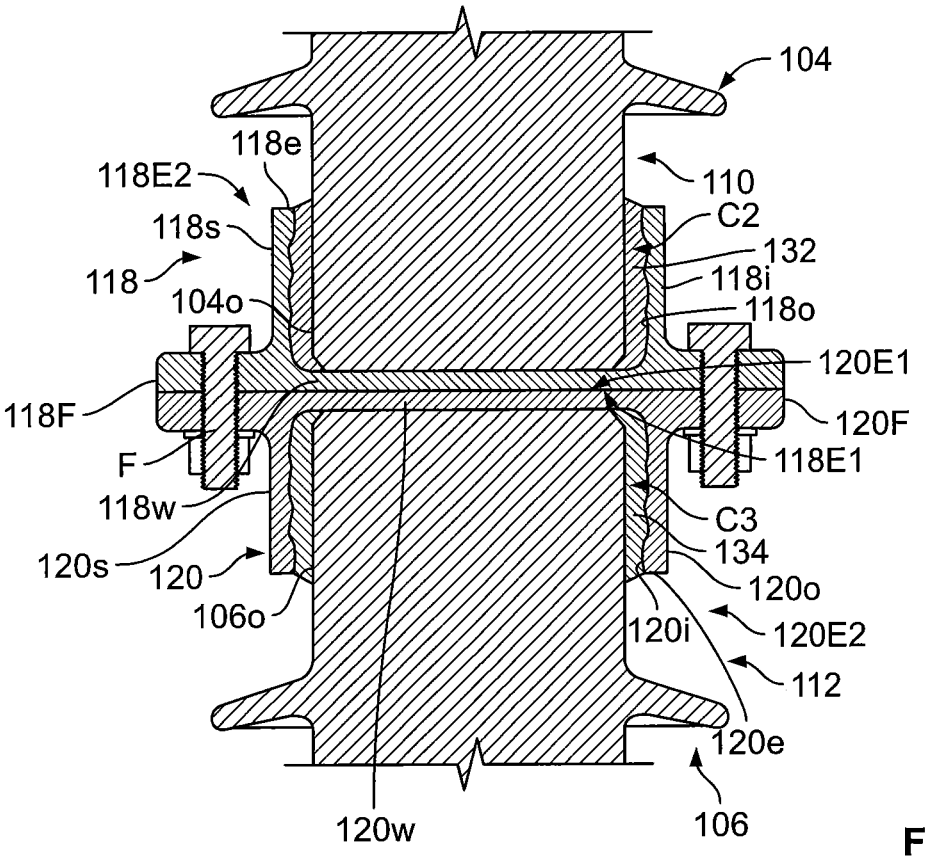
FIG. 2B is a fragmentary sectional view of the insulator system of FIG. 2 taken along line 2B-2B.

Referring to FIG. 2B, the second end fitting 118 has first and second opposite ends 118E1, 118E2. An end wall 118*w* is at the first end 118E1. A sidewall 118*s* extends between the first end 118E1 and the second end 118E2. The sidewall 118*s* terminates at the second end 118E2 and defines an annular edge 118*e*. The end wall 118*w* and the sidewall 118*s* define a cavity C2 in which the second end portion 110 of the first insulator 104 is received. A flange 118F extends outwardly from the end wall 118*w* and/or the sidewall 118*s*.

The second insulator 106 includes first and second end portions 112, 114 (FIG. 2). A third end fitting 120 is at the first end portion 112 and a fourth end fitting 122 is at the second end portion 114 (FIG. 2).

The third end fitting 120 has first and second opposite ends 120E1, 120E2. An end wall 120*w* is at the first end 120E1. A sidewall 120*s* extends between the first end 120E1 and the second end 120E2. The sidewall 120*s* terminates at the second end 120E2 and defines an annular edge 120*e*. The end wall 120*w* and the sidewall 120*s* define a cavity C3 in which the first end portion 112 of the second insulator 106 is received. A flange 120F extends outwardly from the end wall 120W and/or the sidewall 120S.

Figure 2C:
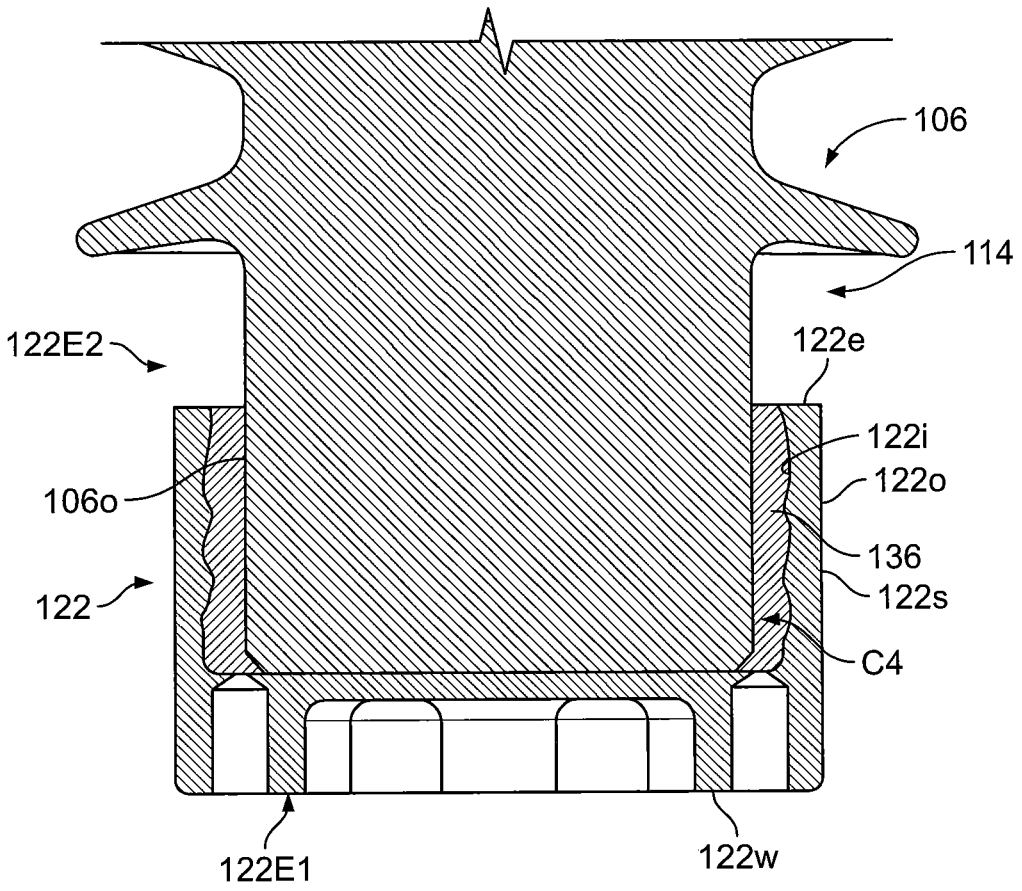
FIG. 2C is a fragmentary sectional view of the insulator system of FIG. 2 taken along line 2C-2C.

Referring to FIG. 2C, the fourth end fitting 122 has first and second opposite ends 122E1, 122E2. An end wall 122*w* is at the first end 122E1. A sidewall 122*s* extends between the first end 122E1 and the second end 122E2. The sidewall 122*s* terminates at the second end 122E2 and defines an annular edge 122*e*. The end wall 122*w* and the sidewall 122*s* define a cavity C4 in which the second end portion 114 of the second insulator 106 is received.

As shown in FIG. 2B, the second end fitting 118 of the first insulator 104 and the third end fitting 120 of the second insulator 106 are coupled to one another such that the first insulator 104 and the second insulator 106 are coupled to one another in series. For example, the flange 118F of the second end fitting 118 and the flange 120F of the third end fitting 120 may be coupled to one another (e.g., using fasteners F). In this configuration, the coupled insulators 104, 106 may have a common longitudinal axis L-L (FIG. 2).

As shown in FIG. 2, the first end fitting 116 of the first insulator 104 is configured to be electrically connected with a high voltage conductor C. The fourth end fitting 122 of the second insulator 106 is configured to be connected to a mounting surface or structure M such as a line post associated with an electric power transmission system. In operation, the fourth end fitting 122 is grounded.

Referring to FIG. 2A, a first cement layer 130 is between the first insulator 104 and the first end fitting 116. Specifically, the first cement layer 130 is between and contacts an outer surface 104*o* of the first insulator 104 and an inner surface 116*i* of the first end fitting 116. The first cement layer 130 may be annular. The first cement layer 130 includes cement and attaches the first end fitting 116 to the first insulator 104. Note that the inner surfaces 116*i*, 118*i*, 120*i*, 122*i* of the end fittings may have an irregular surface which may help the fitting grab onto the cement.

Referring to FIG. 2B, a second cement layer 132 is between the first insulator 104 and the second end fitting 118. Specifically, the second cement layer 132 is between and contacts the outer surface 104*o* of the first insulator 104 and an inner surface 118*i* of the second end fitting 118. The second cement layer 132 may be annular. The second cement layer 132 includes cement and attaches the second end fitting 118 to the first insulator 104.

A third cement layer 134 is between the second insulator 106 and the third end fitting 120. Specifically, the third cement layer 134 is between and contacts an outer surface 106*o* of the second insulator 106 and an inner surface 120*i* of the third end fitting 120. The third cement layer 134 may be annular. The third cement layer 134 includes cement and attaches the third end fitting 120 to the second insulator 106.

Referring to FIG. 2C, a fourth cement layer 136 is between the second insulator 106 and the fourth end fitting 122. Specifically, the fourth cement layer 136 is between and contacts the outer surface 106*o* of the second insulator 106 and an inner surface 122*i* of the fourth end fitting 122. The fourth cement layer 136 may be annular. The fourth cement layer 136 includes cement and attaches the fourth end fitting 122 to the second insulator 106.

The first and second insulators 104, 106 may be formed of any suitable electrically insulating material. For example, each of the first and second insulators 104, 106 may be formed of or include porcelain.

The end fittings 116, 118, 120, 122 may be formed of any suitable electrically conductive material such as metal. For example, each of the end fittings 116, 118, 120, 122 may be formed of or include aluminum or stainless steel.

Referring to FIG. 2A, a corona suppression system 140 includes a layer of dielectric or electrically insulating material 142. The layer 142 may be annular and encircle or surround the first insulator 104. The layer 142 may extend between the outer surface 104*o* of the first insulator 104 and the annular edge 116*e* of the first end fitting 116. The layer 142 may extend between the outer surface 104*o* of the first insulator 104 and an outer surface 116*o* of the first end fitting 116. The layer 142 may contact each of the outer surface 104*o* of the first insulator 104, the first cement layer 130, and the annular edge 116*e* of the first end fitting 116.

The layer 142 may be formed of any suitable dielectric material, electrically insulating material, and/or stress relief material. For example, the layer 142 may be formed of or include room temperature vulcanizing (RTV) silicone.

The present inventors have determined that the area where the metal end fitting, the porcelain insulator, and the cement meet (also referred to herein as the "triple point") is an area of high ionization when the insulator is energized to high voltage. The present inventors discovered that adding the corona suppression system 140 including the layer 142 substantially reduces the ionization and substantially suppresses corona generation. The layer 142 has the additional benefit of keeping moisture out of the cement. It is known to protect the cement from moisture; however, existing moisture protection techniques do not provide RIV (radio interference voltage) suppression (hence the need for corona rings in conventional systems) while the present invention extends to the metal end fitting and provides corona suppression.

Figure 3:
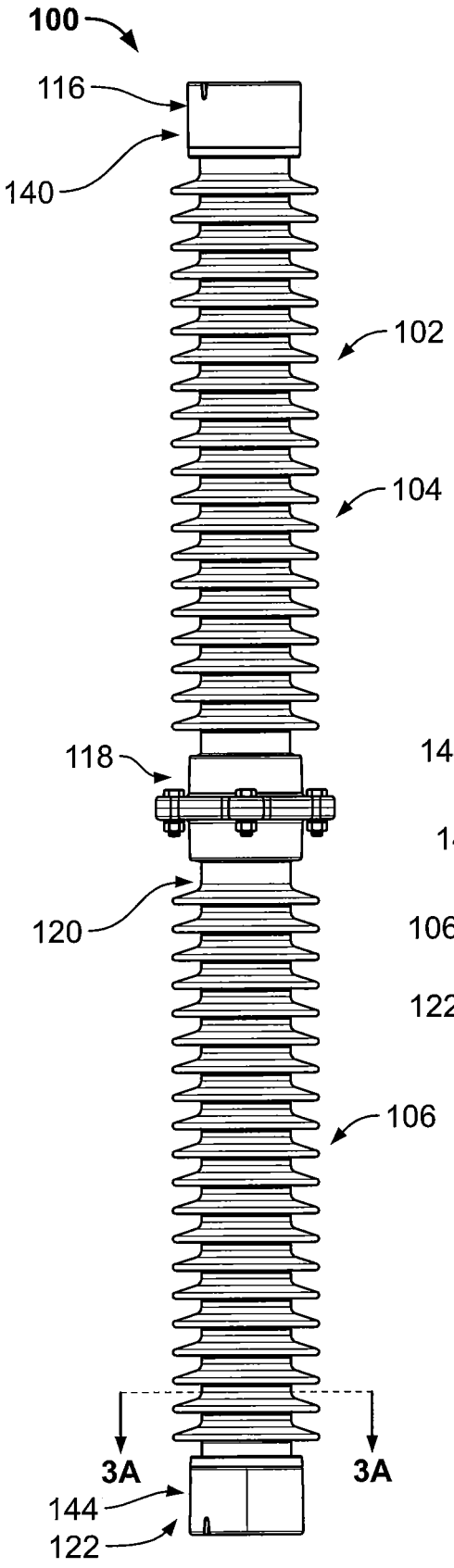
FIG. 3 is a side view of an insulator system according to some embodiments of the present invention.

Referring to FIG. 3, in some embodiments, the system 100 may include the corona suppression system 140 as described above in reference to FIG. 2A and may also include a corona suppression system 144.

The corona suppression system 144 includes a layer of dielectric or electrically insulating material 146. The layer 146 may be annular and encircle or surround the second insulator 106. The layer 146 may extend between the outer surface 106*o* of the second insulator 106 and the annular edge 122*e* of the fourth end fitting 122. The layer 146 may extend between the outer surface 106*o* of the second insulator 106 and an outer surface 122*o* of the fourth end fitting 122. The layer 146 may contact each of the outer surface 106*o* of the second insulator 106, the fourth cement layer 136, and the annular edge 122*e* of the fourth end fitting 122.

The layer 146 may be formed of any suitable dielectric material, electrically insulating material, and/or stress relief material. For example, the layer 146 may be formed of or include room temperature vulcanizing (RTV) silicone.

The corona suppression system 144 may be beneficial for very high voltage applications where the bottom of the insulator system may see a corona effect in addition to the energized high voltage end and/or the intermediate floating objects due to the electric field distribution.

Figure 4:
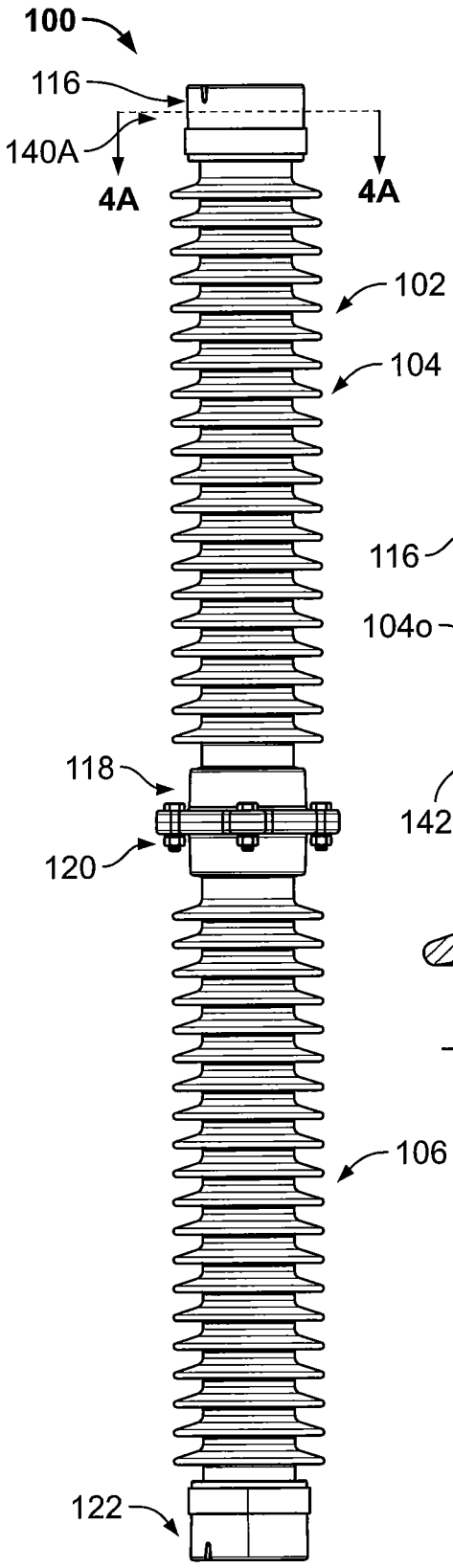
FIG. 4 is a side view of an insulator system according to some embodiments of the present invention.
Figure 4A:
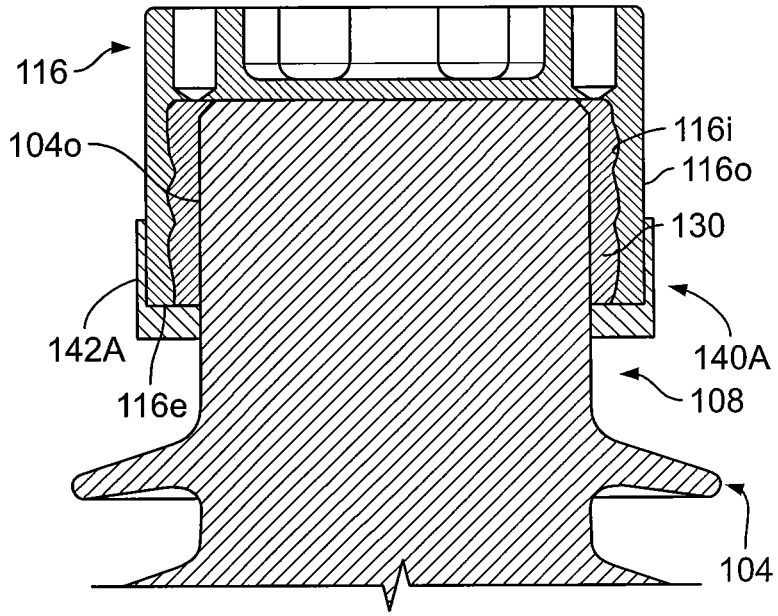
FIG. 4A is a fragmentary sectional view of the insulator system of FIG. 4 taken along line 4A-4A.

Referring to FIGS. 4 and 4A, in some embodiments, the system 100 includes a corona suppression system 140A. The corona suppression system 140A includes a layer of dielectric or electrically insulating material 142A. The layer 142A may be annular and encircle or surround the first insulator 104. The layer 142A may extend continuously from the outer surface 104*o* of the first insulator 104 to the annular edge 116*e* of the first end fitting 116 and along the outer surface 116*o* of the first end fitting 116. The layer 142A may contact each of the outer surface 104*o* of the first insulator 104, the first cement layer 130, the annular edge 116*e* of the first end fitting 116, and the outer surface 116*o* of the first end fitting 116.

The layer 142A may be formed of any suitable dielectric material, electrically insulating material, and/or stress relief material with varying levels of permittivity and or conductivity depending upon the nature of the electric stress relief method. For example, the layer 142A may be formed of or include room temperature vulcanizing (RTV) silicone or a variety of stress relief materials.

The corona suppression system 140A may provide advantages due to the layer 142A covering a greater portion of the metal end fitting 116. This configuration may also increase the dry arcing distance, which may allow for a reduction in the height of the insulators forming the insulator system and/or provide superior electrical performance and properties.

Figure 5:
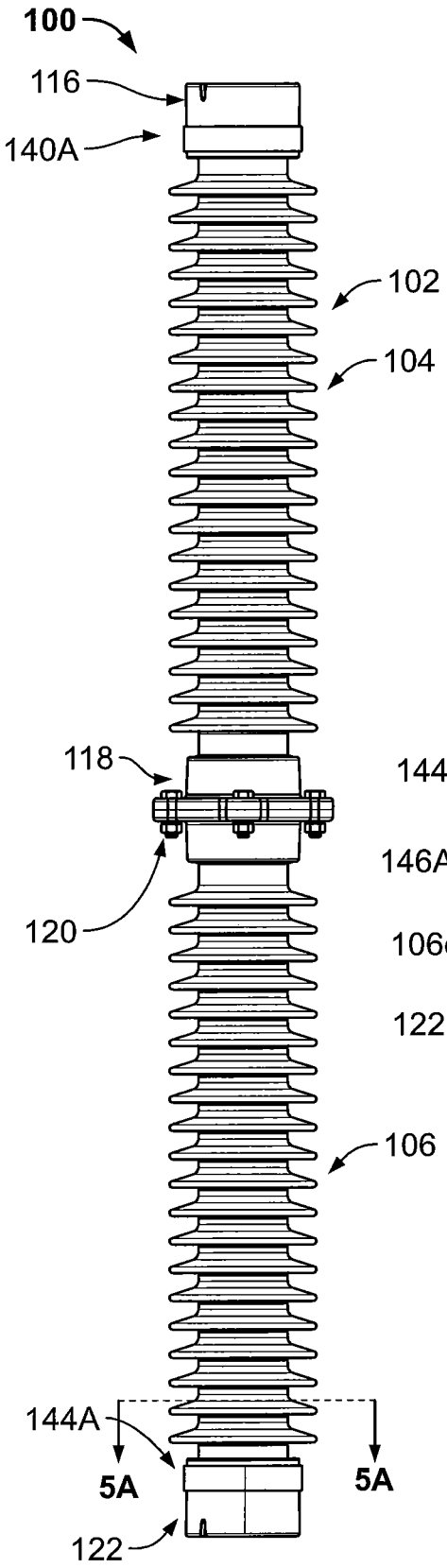
FIG. 5 is a side view of an insulator system according to some embodiments of the present invention.

Referring to FIG. 5, in some embodiments, the system 100 may include the corona suppression system 140A as described above in reference to FIG. 4A and may also include a corona suppression system 144A.

Figure 5A:
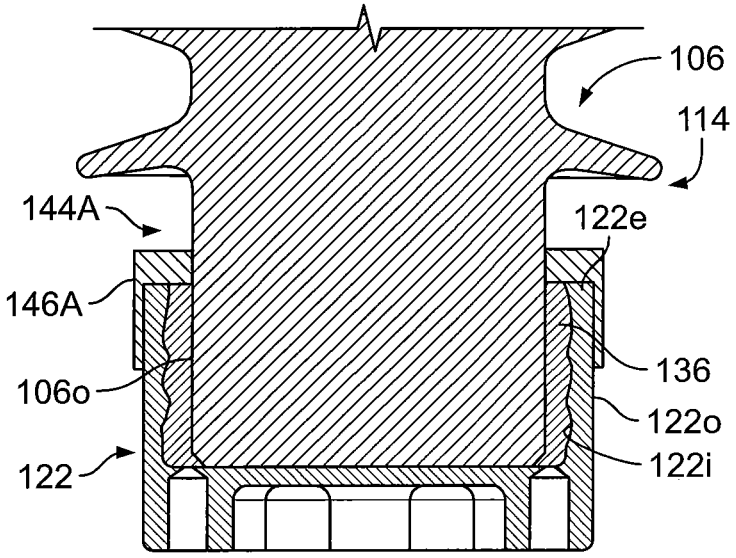
FIG. 5A is a fragmentary sectional view of the insulator system of FIG. 5 taken along line 5A-5A.

Referring to FIG. 5A, the corona suppression system 144A includes a layer of dielectric or electrically insulating material 146A. The layer 146A may be annular and encircle or surround the second insulator 106. The layer 146A may extend continuously from the outer surface 106*o* of the second insulator 106 to the annular edge 122*e* of the fourth end fitting 122 and along the outer surface 122*o* of the fourth end fitting 122. The layer 146A may contact each of the outer surface 106*o* of the second insulator 106, the fourth cement layer 136, the annular edge 122*e* of the fourth end fitting 122, and the outer surface 122*o* of the fourth end fitting 122.

The layer 146A may be formed of any suitable dielectric material, electrically insulating material, and/or stress relief material. For example, the layer 146A may be formed of or include room temperature vulcanizing (RTV) silicone.

The corona suppression systems 140A and 144A may be beneficial for very high voltage applications where the bottom of the insulator system may see a corona effect. Further, the layer 142A covers a greater portion of the metal end fitting 116 and the layer 146A covers a greater portion of the metal end fitting 122. This configuration may also increase the dry arcing distance, which may allow for a reduction in the height of the insulators forming the insulator system and/or provide superior electrical performance and properties.

Figure 6:
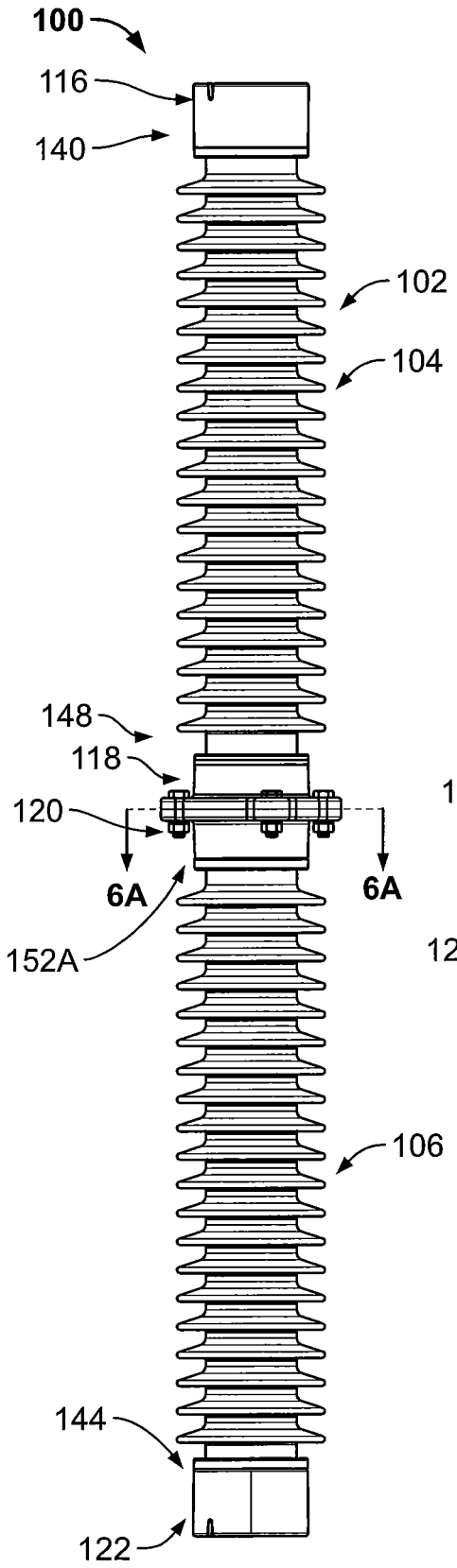
FIG. 6 is a side view of an insulator system according to some embodiments of the present invention.

Referring to FIG. 6, in some embodiments, the system 100 may include the corona suppression systems 140 and 144 as described above in reference to FIG. 3 and may also include corona suppression systems 148 and 152.

Figure 6A:
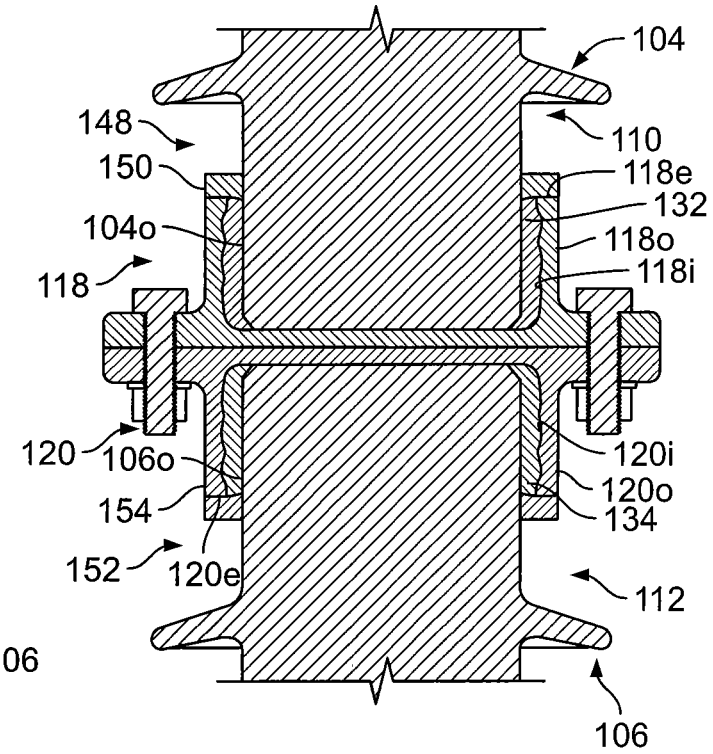
FIG. 6A is a fragmentary sectional view of the insulator system of FIG. 6 taken along line 6A-6A.

Referring to FIG. 6A, the corona suppression system 148 includes a layer of dielectric or electrically insulating material 150. The layer 150 may be annular and encircle or surround the first insulator 104. The layer 150 may extend between the outer surface 104*o* of the first insulator 104 and the annular edge 118*e* of the second end fitting 118. The layer 150 may extend between the outer surface 104*o* of the first insulator 104 and an outer surface 118*o* of the second end fitting 118. The layer 150 may contact each of the outer surface 104*o* of the first insulator 104, the second cement layer 132, and the annular edge 118*e* of the second end fitting 118.

The layer 150 may be formed of any suitable dielectric material, electrically insulating material, and/or stress relief material. For example, the layer 150 may be formed of or include room temperature vulcanizing (RTV) silicone or a variety of stress relief materials.

The corona suppression system 152 includes a layer of dielectric or electrically insulating material 154. The layer 154 may be annular and encircle or surround the second insulator 106. The layer 154 may extend between the outer surface 106*o* of the second insulator 106 and the annular edge 120*e* of the third end fitting 120. The layer 154 may extend between the outer surface 106*o* of the second insulator 106 and an outer surface 120*o* of the third end fitting 120. The layer 154 may contact each of the outer surface 106*o* of the second insulator 106, the third cement layer 134, and the annular edge 120*e* of the third end fitting 120.

The layer 154 may be formed of any suitable dielectric material, electrically insulating material, and/or stress relief material. For example, the layer 154 may be formed of or include room temperature vulcanizing (RTV) silicone or a variety of stress relief materials.

The corona suppression systems 144, 148, and 152 may be beneficial for very high voltage applications where the bottom and/or central portion of the insulator system may see a corona effect.

Figure 7:
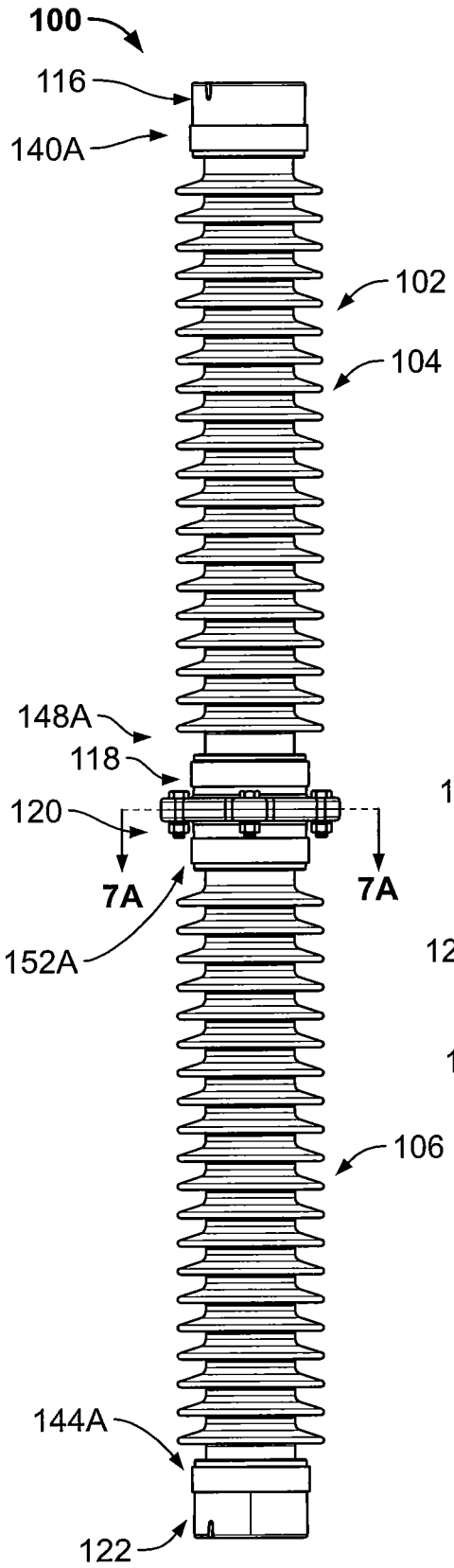
FIG. 7 is a side view of an insulator system according to some embodiments of the present invention.

Referring to FIG. 7, in some embodiments, the system 100 may include the corona suppression systems 140A and 144A as described above in reference to FIG. 5 and may also include corona suppression systems 148A and 152A.

Figure 7A:
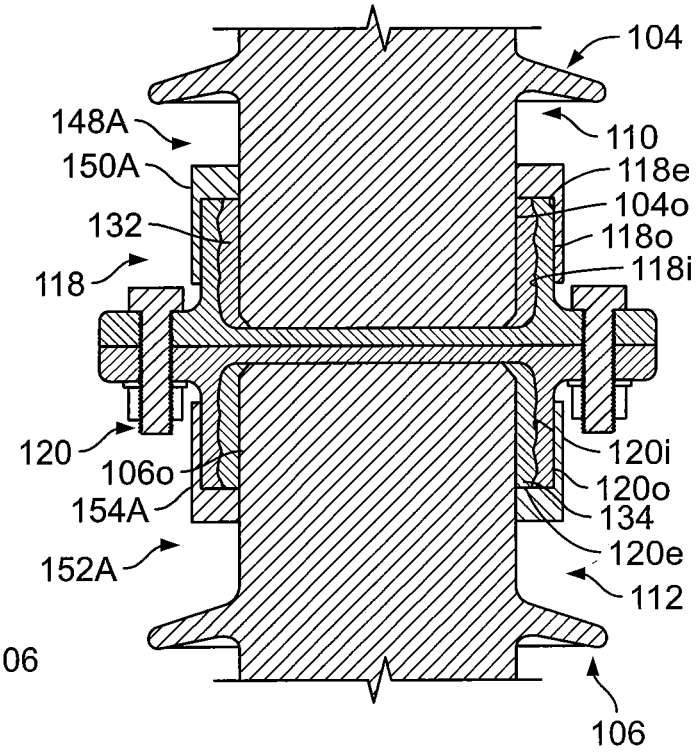
FIG. 7A is a fragmentary sectional view of the insulator system of FIG. 7 taken along line 7A-7A.

Referring to FIG. 7A, the corona suppression system 148A includes a layer of dielectric or electrically insulating material 150A. The layer 150A may be annular and encircle or surround the first insulator 104. The layer 150A may extend continuously from the outer surface 104*o* of the first insulator 104 to the annular edge 118*e* of the second end fitting 118 and along the outer surface 118*o* of the second end fitting 118. The layer 150A may contact each of the outer surface 104*o* of the first insulator 104, the second cement layer 132, the annular edge 118*e* of the second end fitting 118, and the outer surface 118*o* of the second end fitting 118.

The layer 150A may be formed of any suitable dielectric material, electrically insulating material, and/or stress relief material. For example, the layer 150A may be formed of or include room temperature vulcanizing (RTV) silicone or a variety of stress relief materials.

The corona suppression system 152A includes a layer of dielectric or electrically insulating material 154A. The layer 154A may be annular and encircle or surround the second insulator 106. The layer 154A may extend continuously from the outer surface 106*o* of the second insulator 106 to the annular edge 120*e* of the third end fitting 120 and along the outer surface 120*o* of the third end fitting 120. The layer 154A may contact each of the outer surface 106*o* of the second insulator 106, the third cement layer 134, the annular edge 120*e* of the third end fitting 120, and the outer surface 120*o* of the third end fitting 120.

The layer 154A may be formed of any suitable dielectric material, electrically insulating material, and/or stress relief material. For example, the layer 154A may be formed of or include room temperature vulcanizing (RTV) silicone or a variety of stress relief materials.

The corona suppression systems 140A, 144A, 148A, and 152A may be beneficial for very high voltage applications where the bottom and/or central portion of the insulator system may see a corona effect. Further, the layer 142A covers a greater portion of the metal end fitting 116, the layer 150A covers a greater portion of the metal end fitting 118, the layer 154A covers a greater portion of the metal end fitting 120, and the layer 146A covers a greater portion of the metal end fitting 122. This configuration may also increase the dry arcing distance, which may allow for a reduction in the height of the insulators forming the insulator system and/or provide superior electrical performance and properties.

Figure 8:
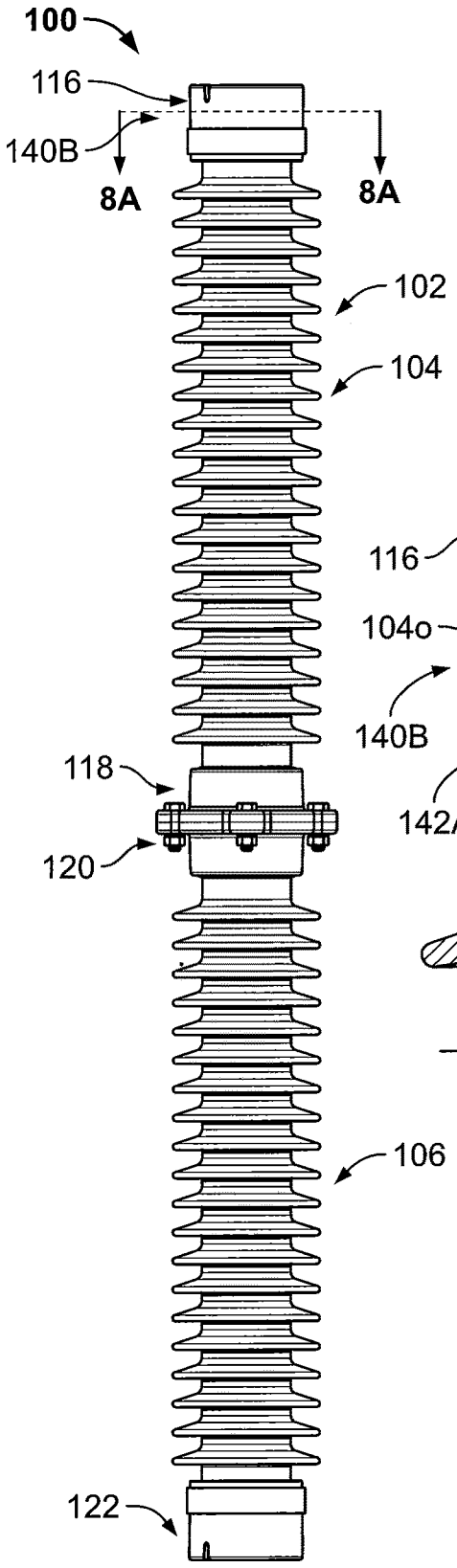
FIG. 8 is a side view of an insulator system according to some embodiments of the present invention.
Figure 8A:
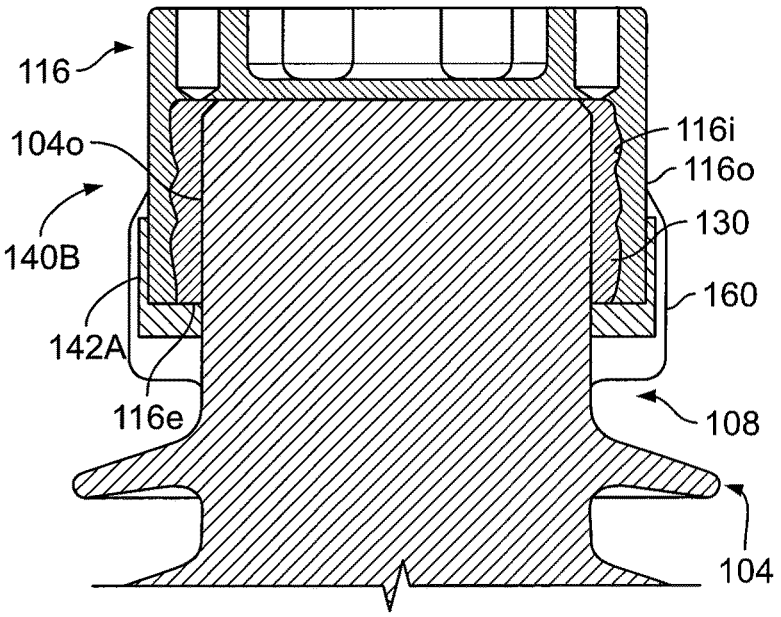
FIG. 8A is a fragmentary sectional view of the insulator system of FIG. 8 taken along line 8A-8A.

Referring to FIGS. 8 and 8A, in some embodiments, the system 100 may include the corona suppression system 140B. The system 140B includes the dielectric or insulating layer 142A described above with regard to FIG. 4A. The system 140B also includes a second dielectric or insulating layer 160 surrounding the layer 142A. The second layer 160 may be formed by heating and shrinking a heat shrinkable tube.

The second layer 160 may serve to protect the first layer 142A (e.g., from the environment) in addition to further improving the corona suppression capabilities. This configuration may also increase the dry arcing distance, which may allow for a reduction in the height of the insulators in addition to improved electrical characteristics forming the insulator system.

Figure 9A:
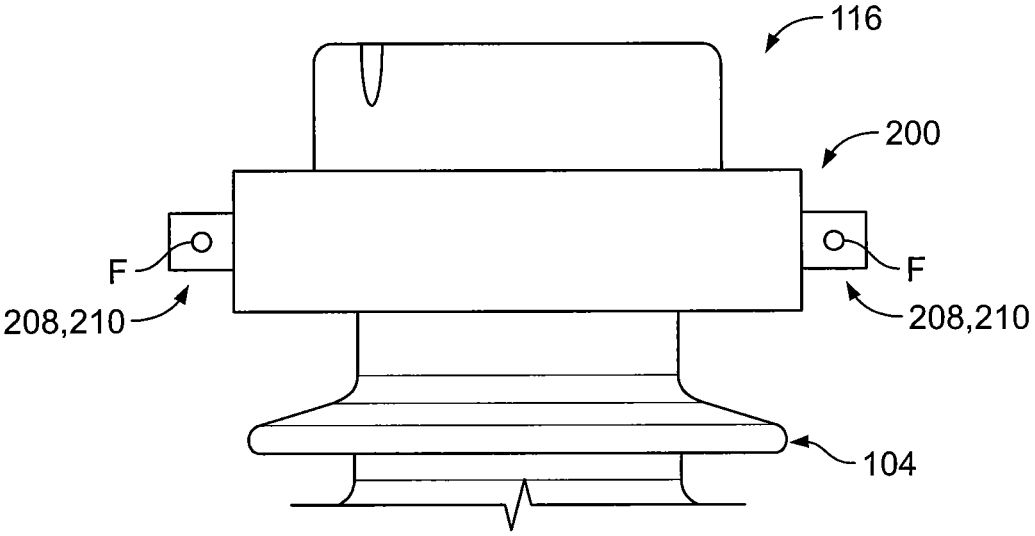
FIG. 9A is a fragmentary side view of an insulator and end fitting with a mold connected to the insulator.
Figure 9B:
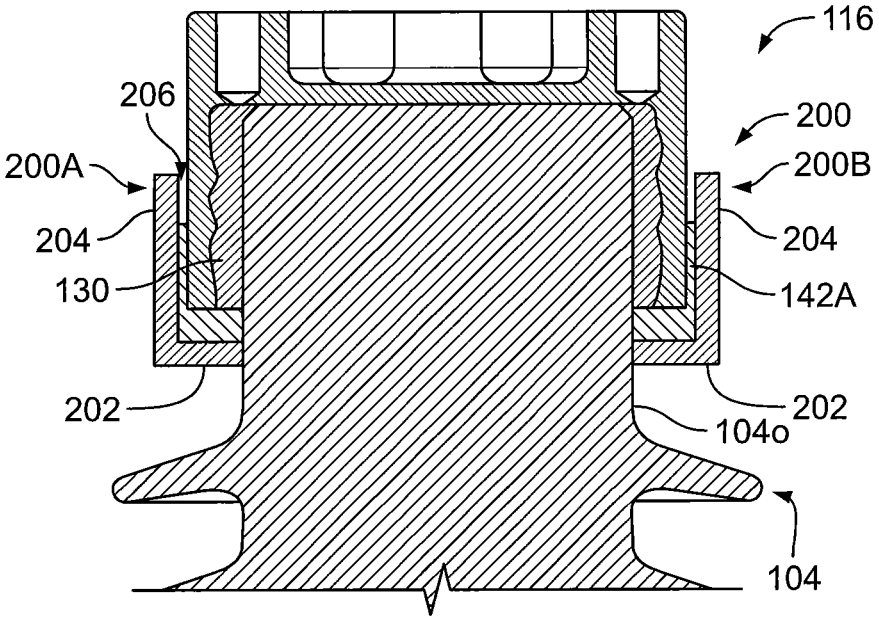
FIG. 9B is a fragmentary sectional view of the insulator and end fitting of FIG. 9A with the mold connected to the insulator.

FIGS. 9A and 9B illustrate an example mold 200 that may be used to form the corona suppression systems described herein. The mold 200 may be received around an insulator (e.g., the first insulator 104 as shown in FIGS. 9A and 9B). A lower portion or lower wall 202 of the mold 200 may surround and contact the outer surface 104*o* of the insulator 104 and may be spaced apart from the first end fitting 116. An upper portion or sidewall 204 of the mold 200 may extend upwardly from the lower portion 202 of the mold and may surround a portion of the first end fitting 116. A channel 206 is defined between the lower wall 202, the sidewall 204, the first insulator 104, the first cement layer 130, and/or the first end fitting 116. Material to form the layer of the corona suppression system may be received in the channel 206 where it may then cure. For example, room temperature vulcanizing silicone may be received in the channel 206 to form the layer 142 (see also FIG. 2A) or, as illustrated, layer 142A (see also FIG. 4A). The mold 200 may include two parts or sections 200A, 200B that may be coupled together by flanges 208, 210 and fasteners F. It will be appreciated that the other layers of the other corona suppression systems described herein can be formed in a similar manner using the mold 200 adjacent the appropriate end fitting.

Figure 3A:
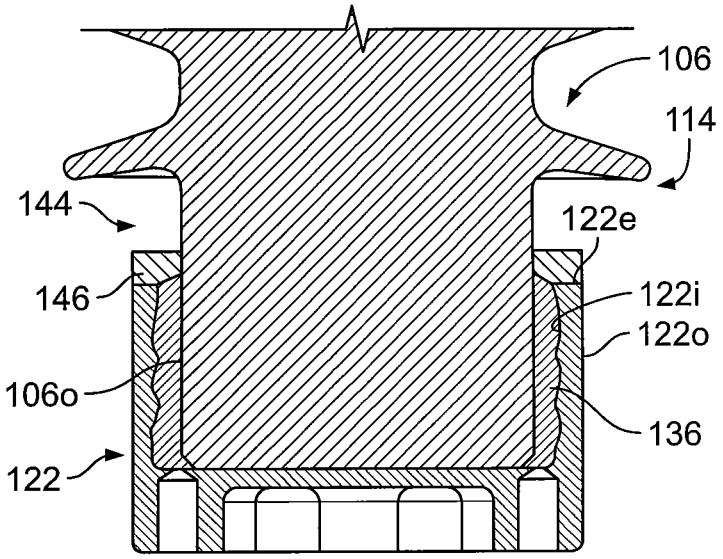
FIG. 3A is a fragmentary sectional view of the insulator system of FIG. 3 taken along line 3A-3A.
Figure 10:
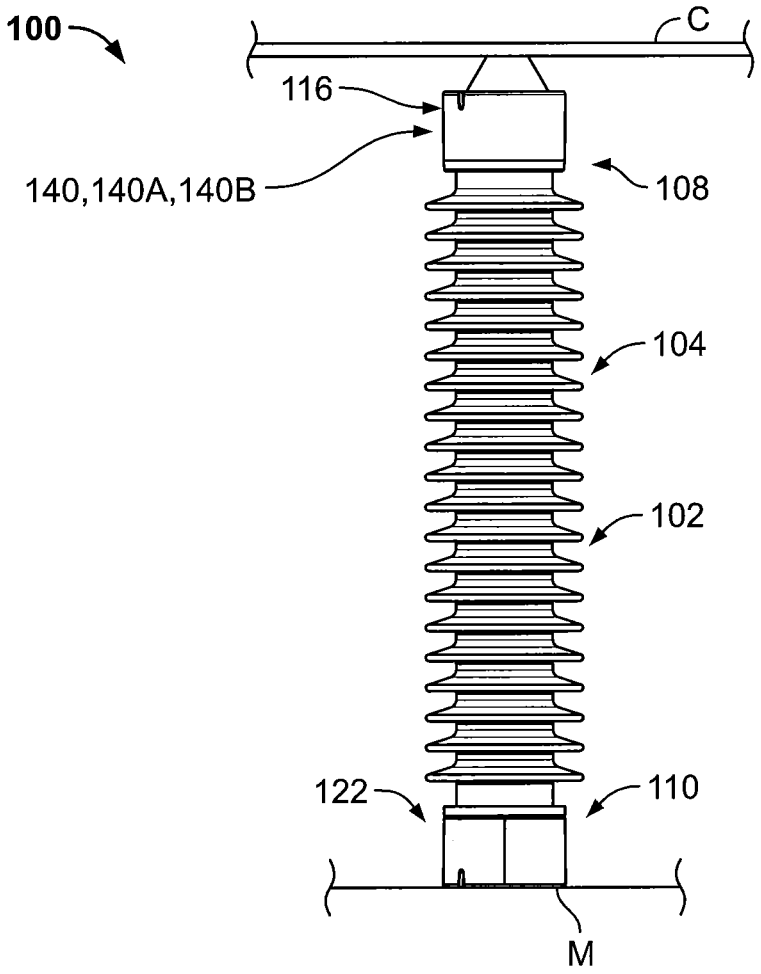
FIG. 10 is a side view of an insulator system according to some embodiments of the present invention.

Although insulator systems having two insulators have been described, it will be appreciated that the corona suppression systems described herein can be used with insulator systems having one insulator or insulator systems having more than two insulators. For example, referring to FIG. 10, only the first insulator 104 may be used. The fourth end fitting 122 may be used in place of the second end fitting 118 for mounting the insulator system to a mounting structure or surface M. Corresponding layers such as the cement layers and/or electrically insulating layers may be used as shown in FIGS. 2C, 3A, and 5A.

Figure 11:
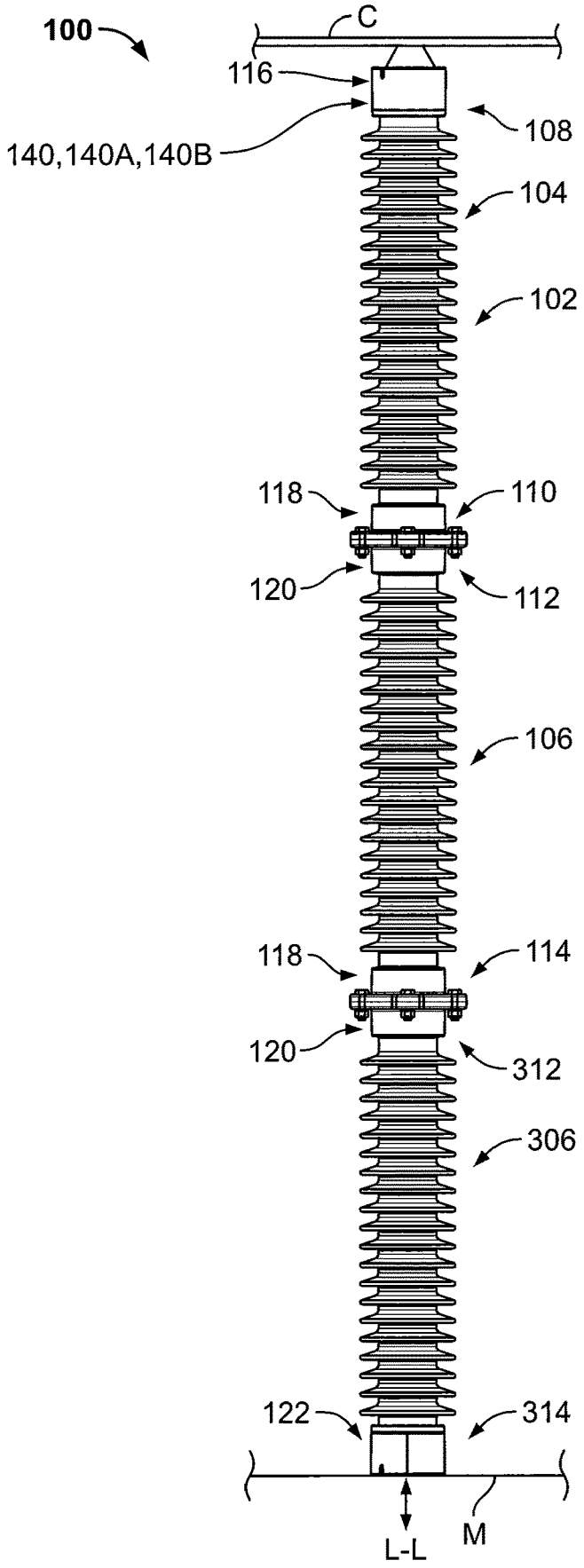
FIG. 11 is a side view of an insulator system according to some embodiments of the present invention.

As another example, referring to FIG. 11, end fittings the same or similar to the second and third end fittings 118, 120 may be used in place of the fourth end fitting 122 for coupling a third insulator 306 (the same or similar to the first and second insulators 104, 106) to the first and second insulators 104, 106. Corresponding layers such as the cement layers and/or electrically insulating layers may be used as shown in FIGS. 2B, 6A, and 7A. The third insulator 306 includes first and second opposite end portions 312, 314. The fourth end fitting 122 could then be used at the second end portion 314 of the third insulator for mounting the insulator system to a mounting structure or surface M. Corresponding layers such as the cement layers and/or electrically insulating layers may be used as shown in FIGS. 2C, 3A, and 5A.

It will be understood that more than three insulators may be used in an insulator system. It will be apparent that additional end fittings and corresponding layers such as the cement layers and/or electrically insulating layers may be used in such systems.

The corona suppression systems described herein allow for high voltage insulator systems to be used without corona rings. The problem of corona discharge may be solved with one or more dielectric or electrically insulating layers positioned at the area or point determined to have high ionization. The layer(s) can be installed by the manufacturer and eliminate the need for the installer to connect the corona ring, which needs to be specially sized and positioned based on the use (e.g., voltage). In addition to making installation easier, the cost of the insulator systems can be reduced due to the elimination of the corona ring.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

The invention claimed is:

1. A high voltage insulator system comprising:

an insulator assembly comprising:

a first elongated insulator comprising first and second opposite end portions;

a second elongated insulator comprising first and second opposite end portions;

a first end fitting at the first end portion of the first insulator, the first end fitting configured to be electrically connected with a high voltage conductor;

a second end fitting at the second end portion of the first insulator;

a third end fitting at the first end portion of the second insulator, wherein the second end fitting and the third end fitting are operatively coupled to one another such that the first insulator and the second insulator are operatively coupled to one another with a common longitudinal axis;

a fourth end fitting at the second end portion of the second insulator, the fourth end fitting configured to be coupled to a mounting structure;

a first cement layer between the first insulator and an inner surface of the first end fitting;

a second cement layer between the first insulator and an inner surface of the second end fitting;

a third cement layer between the second insulator and an inner surface of the third end fitting; and a fourth cement layer between the second insulator and an inner surface of the fourth end fitting; and an annular electrically insulating layer on the first cement layer and extending between the first insulator and an outer annular edge of the first end fitting.

2. The system of claim 1 wherein the electrically insulating layer directly contacts each of the first insulator, the first cement layer, and the first end fitting.

3. The system of claim 1 wherein the electrically insulating layer extends continuously from an outer surface of the first insulator to the outer annular edge of the first end fitting and along an outer surface of the first end fitting.

4. The system of claim 3 wherein the electrically insulating layer directly contacts each of the first insulator, the first cement layer, and the outer surface of the first end fitting.

5. The system of claim 1 wherein the electrically insulating layer comprises room temperature vulcanizing silicone.

6. The system of claim 1 wherein:

the first end fitting is adhered to the first insulator by the first cement layer;

the second end fitting is adhered to the first insulator by the second cement layer;

the third end fitting is adhered to the second insulator by the third cement layer; and the fourth end fitting is adhered to the second insulator by the fourth cement layer.

7. The system of claim 1 wherein:

the electrically insulating layer is a first electrically insulating layer; and the system further comprises a second annular electrically insulating annular layer on the fourth cement layer and extending between the second insulator and an outer annular edge of the fourth end fitting.

8. The system of claim 7 wherein the second electrically insulating layer directly contacts each of the second insulator, the fourth cement layer, and the fourth end fitting.

9. The system of claim 7 wherein the second electrically insulating layer extends continuously from an outer surface of the second insulator to the outer annular edge of the fourth end fitting and along an outer surface of the fourth end fitting.

10. The system of claim 9 wherein the second electrically insulating layer directly contacts each of the second insulator, the fourth cement layer, and the outer surface of the fourth end fitting.

11. The system of claim 7 further comprising:

a third annular electrically insulating layer on the second cement layer and extending between the first insulator and an outer annular edge of the second end fitting; and a fourth annular electrically insulating layer on the third cement layer and extending between the second insulator and an outer annular edge of the third end fitting.

12. The system of claim 11 wherein:

the third electrically insulating layer directly contacts each of the first insulator, the second cement layer, and the second end fitting; and/or the fourth electrically insulating layer directly contacts each of the second insulator, the third cement layer, and the third end fitting.

13. The system of claim 11 wherein:

the third electrically insulating layer extends continuously from an outer surface of the first insulator to the outer annular edge of the second end fitting and along an outer surface of the second end fitting; and/or the fourth electrically insulating layer extends continuously from an outer surface of the second insulator to the outer annular edge of the third end fitting and along an outer surface of the third end fitting.

14. The system of claim 13 wherein:

the third electrically insulating layer directly contacts each of the first insulator, the second cement layer, and the outer surface of the second end fitting; and/or the fourth electrically insulating layer directly contacts each of the second insulator, the third cement layer, and the outer surface of the third end fitting.

15. An insulator system comprising:

an insulator assembly comprising:

an elongated insulator comprising first and second opposite end portions;

a first end fitting at the first end portion of the first insulator, the first end fitting configured to be electrically connected with a high voltage conductor;

a second end fitting at the second end portion of the first insulator, the second end fitting connected to a mounting structure;

a first cement layer between the first insulator and an inner surface of the first end fitting; and a second cement layer between the first insulator and an inner surface of the second end fitting; and an annular electrically insulating layer on the first cement layer and extending between the first insulator and an outer annular edge of the first end fitting.

16. The system of claim 15 wherein the second end fitting is directly connected to the mounting structure.

17. The system of claim 15 wherein:

the insulator is a first insulator;

the insulator assembly further comprises:

a second elongated insulator comprising first and second opposite end portions;

a third elongated insulator comprising first and second opposite end portions;

a third end fitting at the first end portion of the second insulator, wherein the second end fitting and the third end fitting are coupled to one another such that the first insulator and the second insulator are coupled to one another with a common longitudinal axis;

a fourth end fitting at the second end portion of the second insulator;

a fifth end fitting at the first end portion of the third insulator, wherein the fourth end fitting and the fifth end fitting are coupled to one another such that the second insulator and the third insulator are coupled to one another with the common longitudinal axis; and a sixth end fitting at the second end portion of the third insulator; and the sixth end fitting is directly connected to the mounting structure.

18. The system of claim 15 further comprising the high voltage conductor.

* * * * *